US008272834B2

(12) United States Patent
Lefevre

(10) Patent No.: US 8,272,834 B2
(45) Date of Patent: Sep. 25, 2012

(54) ACOUSTIC DAMPER INTEGRATED TO A COMPRESSOR HOUSING

(75) Inventor: Thierry Lefevre, Dogneville (FR)

(73) Assignee: Honeywell International Inc., Morristown, NJ (US)

( * ) Notice: Subject to any disclaimer, the term of this patent is extended or adjusted under 35 U.S.C. 154(b) by 1326 days.

(21) Appl. No.: 11/629,438

(22) PCT Filed: Jun. 15, 2004

(86) PCT No.: PCT/EP2004/006445

§ 371 (c)(1),
(2), (4) Date: Dec. 7, 2007

(87) PCT Pub. No.: WO2005/124159

PCT Pub. Date: Dec. 29, 2005

(65) Prior Publication Data

US 2008/0292449 A1 Nov. 27, 2008

(51) Int. Cl.
*F04D 29/66* (2006.01)

(52) U.S. Cl. ..... 415/119

(58) Field of Classification Search ..... 415/119, 415/56.5, 57.1; 60/605.1, 605.2
See application file for complete search history.

(56) References Cited

U.S. PATENT DOCUMENTS

| | | | | |
|---|---|---|---|---|
| 4,930,979 | A * | 6/1990 | Fisher et al. | 415/58.4 |
| 5,295,785 | A * | 3/1994 | Church et al. | 415/58.3 |
| 5,399,064 | A * | 3/1995 | Church et al. | 415/58.3 |
| 6,623,239 | B2 * | 9/2003 | Sahay et al. | 415/119 |
| 7,083,379 | B2 * | 8/2006 | Nikpour et al. | 415/56.5 |
| 7,229,243 | B2 * | 6/2007 | Nikpour et al. | 415/57.1 |
| 7,549,506 | B2 * | 6/2009 | Sattinger | 181/213 |
| 7,942,625 | B2 * | 5/2011 | Sirakov et al. | 415/56.5 |
| 2002/0015640 | A1 * | 2/2002 | Nishiyama et al. | 415/119 |
| 2008/0056882 | A1 * | 3/2008 | Clay et al. | 415/55.6 |

* cited by examiner

*Primary Examiner* — Edward Look
*Assistant Examiner* — Aaron R Eastman
(74) *Attorney, Agent, or Firm* — Brian J. Pangrle

(57) ABSTRACT

A compressor housing for accommodating a compressor wheel comprises an inlet and an outlet, each being defined by a wall provided integrally with said compressor housing, wherein at least one acoustic damper element is disposed on the outside of at least one of said walls of the inlet and the outlet. Preferably, the acoustic damper element is integrally formed with the compressor housing by die casting. A compressor or a turbocharger can be equipped with the compressor housing.

16 Claims, 4 Drawing Sheets

A - A

B - B

B' - B'

ACOUSTIC DAMPER INTEGRATED TO A COMPRESSOR HOUSING

The present invention relates to an acoustic damper element integrated to a compressor housing for a turbocharger.

Turbochargers are well known and widely used in connection with combustion engines. Exhaust gas from an engine is supplied to and drives a turbine wheel which drives a compressor wheel. The compressor wheel compresses air and discharges it into combustion chambers of respective cylinders. The thus compressed air contains an increased amount of oxygen per volume unit to enhance the combustion of fuel and thus to generate more power. Generally, the exhaust gas supplied to the turbine wheel is passed through an inlet and a volute to the turbine wheel and then exits through an outlet with the turbine wheel rotating at a very high speed. The fast rotation of the turbine is transmitted to the compressor wheel so as to compress the air drawn in at the inlet of the compressor housing. This high speed rotation of the compressor wheel causes the compressor blades to generate high levels of noise which are known as "Blade Passing Frequency Noises" and occur at the inlet of the compressor where the blades pass by the compressor housing wall. Furthermore, the air discharged through the compressor outlet generates noises which are known as "Pulsation".

To increase the performance of compressors there is often added a bypass port to the compressor inlet, typically utilizing a ported shroud configuration. Such a ported shroud provides the inlet of the compressor housing with a primary inlet portion and a secondary inlet portion surrounding the primary inlet portion. Therein, the secondary inlet portion can activate in addition to the primary inlet portion at a high rotational speed of the compressor wheel to ensure a higher amount of inlet air drawn-in by the compressor wheel.

In the past, there have been made different proposals to provide acoustic damper elements to cope with the noises generated at the ported shroud of the compressor housing, an example of which is disclosed in the WO 02/48550. According to this device, the ported shroud is provided with noise deflectors in the secondary inlet portion for reducing the noise transmission therethrough by blocking the linear flow of sound waves and by increasing the length of the path which the sound waves must travel to escape from the compressor.

Furthermore, one known conventional solution for coping with the Pulsations generated at the compressor outlet resides in providing a hose connected thereto and equipped with a noise suppressor or a silencer, as can be seen in the GB 2 381 834, as an example. According to this device, modular portions are connected in series to define noise suppression chambers and are then arranged in a hose connected to the compressor outlet.

Accordingly, there is a need to provide an improved compressor housing in which noises generated by the compression of air can appropriately be damped and which is easy to manufacture.

In an exemplary embodiment of the invention, a compressor housing for accommodating a compressor wheel comprises an inlet and an outlet, each being defined by a wall provided integrally with said compressor housing, wherein at least one acoustic damper element is disposed on the outside of the inlet. Additionally, an acoustic damper element may also be provided at the outside of outlet of the compressor housing. With such a device, noises generated in the compressor housing by the rotation of the compressor wheel or by the compression of the air are efficiently damped very close to the place where the noises are generated.

According to exemplary embodiments, the inlet further may comprise a ported shroud arrangement, wherein the acoustic damper element of the inlet is disposed at the wall of the inlet at an axial position thereof corresponding to the ported shroud arrangement. This allows efficient damping of noises which are inherent with the provision of a ported shroud arrangement.

According to another exemplary embodiment, the acoustic damper element may be disposed lengthwise along at least a portion of said wall. Additionally, the acoustic damper element may be in contact with the wall of the inlet or of the outlet of the compressor housing. Furthermore the acoustic damper element may be provided integrally with said wall of the compressor housing, which results in having less parts when assembling a turbocharger utilizing the compressor housing. Preferably, the acoustic damper element is formed by casting it integrally with the compressor housing. This is a very efficient and economic manufacturing method. However, alternatively, the acoustic damper element may be welded, brazed or bonded to the compressor housing.

Preferably, the acoustic damper element may be a pulsation type damper element. For this purpose, the acoustic damper element may define at least one hollow space inside thereof. Furthermore, the acoustic damper element may communicate with the inner side of said wall through holes or openings penetrating said wall. Accordingly, by providing the hollow space with a certain volume and the openings with a certain area and thickness, the frequency range at which the damper is effective can be tuned. Preferably, the hole is provided in the form of a slot extending in a direction perpendicular to an axis of the inlet or the outlet, respectively. Alternatively, the a plurality of openings are provided along a line extending in a direction perpendicular to an axis of the inlet or the outlet, respectively. Furthermore, the acoustic damper element may at least partly surround said wall.

Additionally, the hollow space of the acoustic damper may be divided by at least one wall. This provides an acoustic damper element having a plurality of hollow spaces (also called cavities) of a pulsation damper, each being adjusted to a certain noise frequency range by giving the hollow space a certain volume. Preferably, the divided hollow spaces are not directly in communication with each other and each of the divided hollow spaces has at least one respective hole or opening for connecting the hollow space to the inside of the respective wall.

According to another aspect of the invention, a compressor housing for accommodating a compressor wheel comprises an inlet and an outlet, each being defined by a wall provided integrally with said compressor housing, wherein at least one acoustic damper element of the Helmholtz type is disposed on the outside of the outlet. Preferably, the acoustic damper element is disposed at a position corresponding to the position of the smallest internal diameter of the outlet.

Furthermore, the compressor housing according to this aspect of the invention may further comprise all the features defined for the compressor housing according to the first aspect of the invention. Accordingly, the acoustic damper element of the Helmholtz type is established based on a mass-spring system represented by the volume of the hollow space as a mass and the volume of the hole or opening as a spring. By providing certain dimensions of the volume of the hollow space and dimensions of the hole, the frequency range at which the acoustic damper element is effective can easily be tuned to a required frequency range.

According to another aspect of the invention, a compressor comprises a compressor housing provided with all the features set forth above for the compressor housing and can accordingly obtain the same advantages.

According to another aspect of the invention, a turbocharger has a turbine for driving a compressor wheel accommodated in a compressor housing having all the features set forth above for the compressor housing and can accordingly obtain the same advantages.

Furthermore, the turbocharger may further comprise an electric motor for electrically assisting the driving of the compressor wheel.

In the following, further technical solutions of the object are described in detail with reference being made to the enclosed drawings, in which.

A first exemplary embodiment of an acoustic damper element 1 provided at an inlet 2 of a compressor housing 3 of an electrically assisted turbocharger 4 is explained with reference being made to FIGS. 1 to 3.

Figure 1:
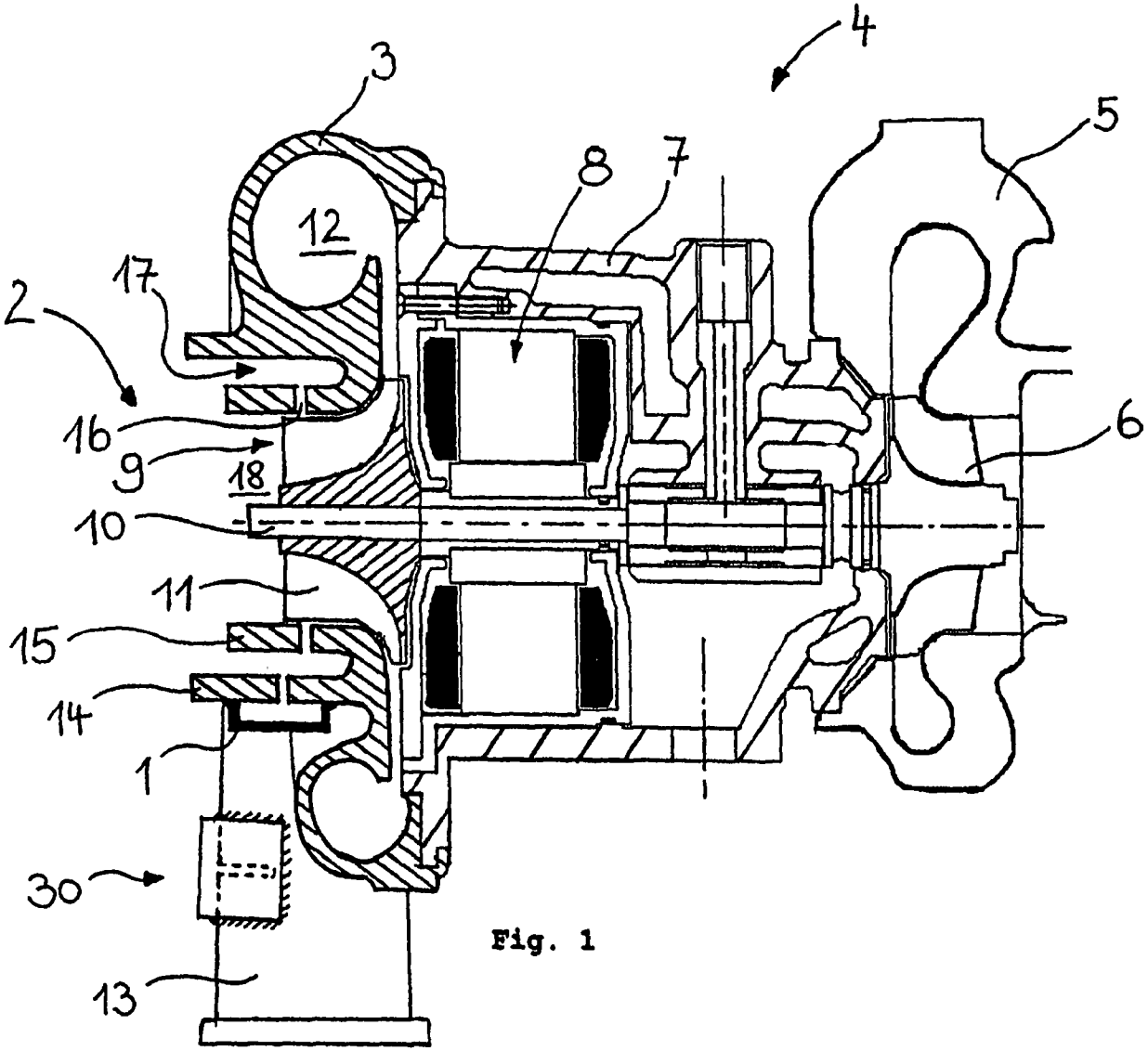
FIG. 1 is sectional view of a part of a turbocharger schematically showing a compressor housing provided with an acoustic damper element at a compressor inlet according to a first embodiment of the invention.

The turbocharger 4 shown in FIG. 1 comprises a turbine housing 5 for accommodating a turbine wheel 6, a center housing 7 for accommodating an electric motor 8 and the compressor housing 3 for accommodating a compressor wheel 9. The turbine housing 5 is disposed at the right hand side and the compressor housing is disposed at the left hand side of the center housing 7, respectively. A shaft 10 extends through the center housing 3 and connects the turbine wheel 6 to the compressor wheel 9.

Generally, the compressor wheel 9 is driven by the turbine wheel 6 due to the exhaust gas flowing through an inlet and a volute of the turbine housing 5 thus driving the turbine wheel 6. When the energy content of the exhaust gas is too low to produce a required charging air pressure, the driving of the compressor wheel 9 is assisted by the electric motor 8.

The driving of the compressor wheel 9 draws air into the compressor housing 3 through the inlet 2, compresses it by passing it through a volute 12 and discharges it at a compressor housing outlet 13. The inlet 2 of the compressor housing 3 is formed by a cylindrical outer wall 14 and a cylindrical inner wall 15 which both extend over the left hand side end of blades 11 of the compressor wheel 9, as seen in FIG. 1. The outer wall 14 extends farther to the left hand side than the inner wall 15. The outer wall 14 and the inner wall 15 form an annular space 17 which is open to the left hand side and is closed to the right hand side. The annular space 17 surrounds the space of the inlet 2 where the compressor wheel 9 is accommodated and communicates with this space through an annular slot 16 of the inner wall 15. Thus, the blades 11 pass by the annular slot 16 when the compressor wheel 9 rotates. In such a configuration, the space inside the inner wall 15 is called a primary inlet 18 while the annular space 17 is called a secondary inlet.

With the compressor wheel 9 rotating at low speeds, air is drawn into the compressor housing 3 through the primary inlet 18 and compressed in the volute 12. When the speed of the compressor wheel 9 is increased, the pressure within the secondary inlet, which is the annular space 17, becomes lower than the atmospheric pressure and additional air is drawn to the compressor wheel 9 from the annular space 17 through the annular slot 16 with the result of increasing the amount of air reaching the compressor wheel 9. When the speed of the compressor wheel 9 is again decreased largely, the pressure along the blades 11 becomes higher than the pressure within the annular chamber 17 and the air can flow outward from the space of the compressor wheel 9 through the annular slot 16 to the annular space 17. Thus, by means of such a ported shroud assembly, an improved compressor flow range is achieved.

Due to the blades 11 passing by the annular slot 16 of the inner wall 15 and due to the air flowing through the annular slot 16 from and to the annular space 17, noises (Blade Passing Frequency Noises) are generated which are damped by the acoustic damper element 1.

Figure 2:
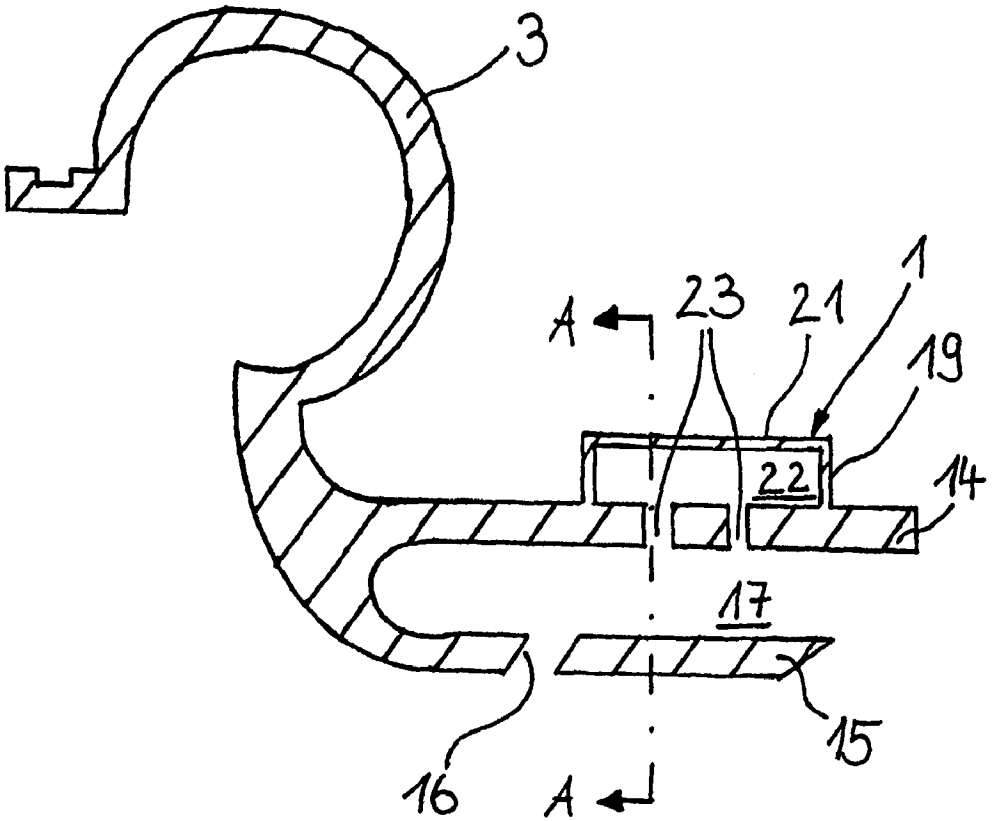
FIG. 2 is an enlarged sectional view of the compressor inlet of FIG. 1.
Figure 3:
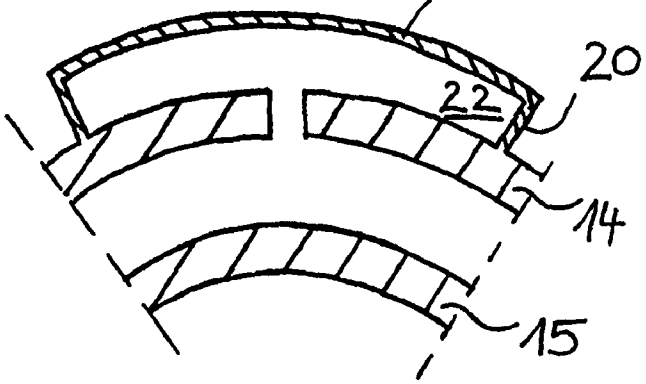
FIG. 3 is a sectional view along the line A-A of FIG. 2.

The acoustic damper element 1 is, as can best be seen from FIGS. 2 and 3, disposed at the outer face of the outer wall 14, and is substantially formed like a box comprising curved side walls 19 matching to the outer wall 14 of the compressor housing 3, straight side walls 20 and a top shell wall 21 which is curved to be coaxial to the outer wall 14. Preferably, the acoustic damper element 1 is integrally formed with the compressor housing 3 by casting, e.g. by a die casting process.

The walls 19, 20 and 21 of the acoustic damper 1 constitute, together with the outer wall 14 of the compressor housing 3, a damper cavity or hollow space 22 which communicates with the annular space 17 via a slot 23 in the outer wall 14. As can be seen from FIG. 4, the slot 23 extends in a direction perpendicular to the axis of the inlet. Thus, the acoustic waves of the blade passing noises generated by the blades 11 passing the annular slot 16 can propagate through the annular space 17 and the slot 23 into the acoustic damper cavity 22 where they are absorbed. By providing the cavity 22 with a certain volume and the slots 23 with a certain opening area and thickness (radial length) a Helmhotz type resonator is established with which the frequency range at which the damper element 1 is effective can easily be tuned. Thus, the amplitude of the acoustic waves corresponding to this frequency range is attenuated and the noises are damped. Known frequencies of acoustic waves occurring at the compressor inlet range between 6000 and 15000 Hz and the acoustic damper element 1 is tuned accordingly.

Another exemplary embodiment of an acoustic damper element 30 is explained with reference being made to FIGS. 1, 4 and 5.

Figure 4:
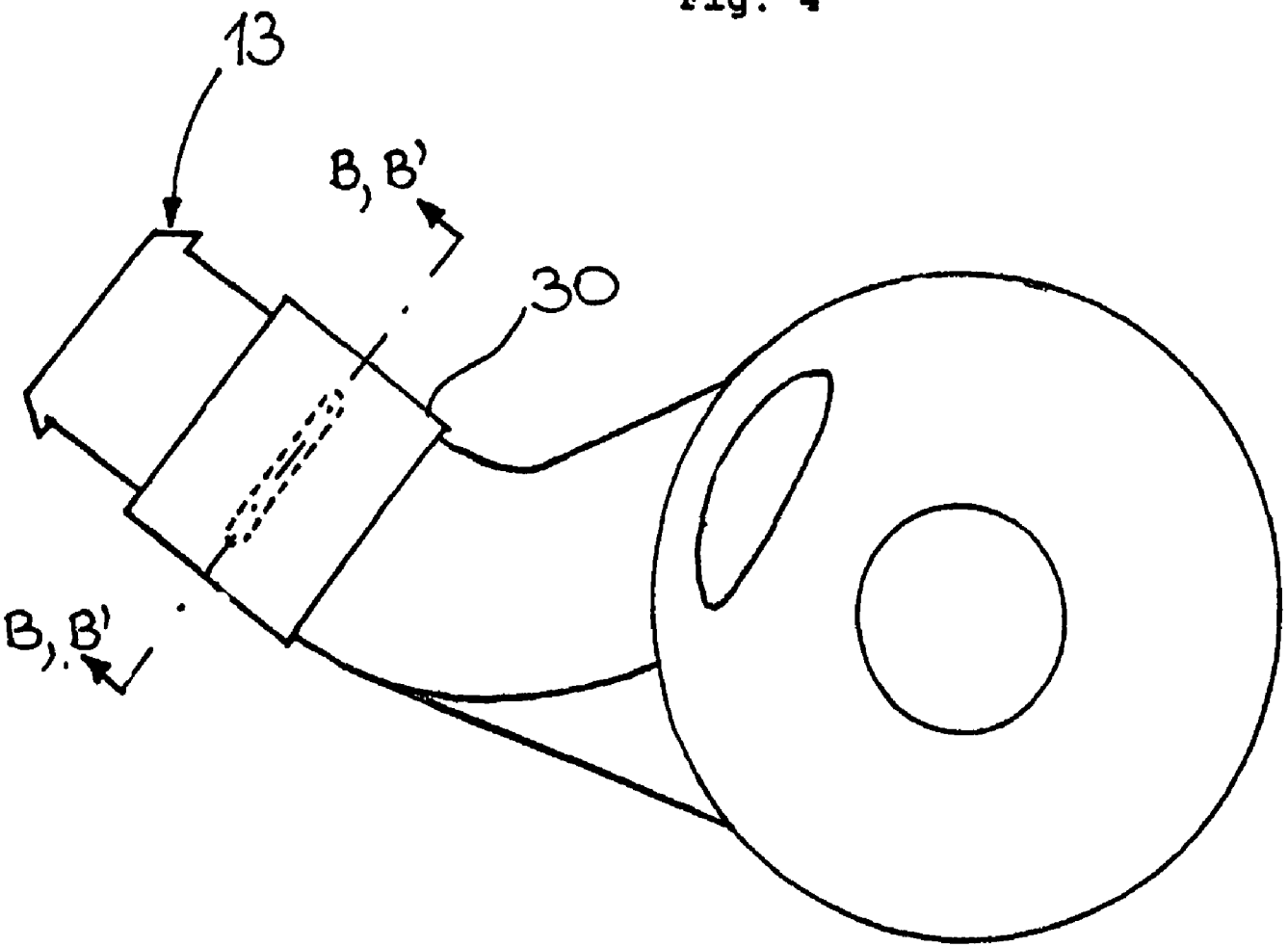
FIG. 4 is a view of a compressor housing schematically showing an acoustic damper element provided on the compressor outlet according to a second embodiment of the invention.

According to this embodiment, the damper element 30 is provided at the outlet 13 of the compressor housing 3, as can best be seen in FIGS. 1 and 4. According to what is shown in FIG. 5, the acoustic damper element 30 has substantially the same configuration as that of the inlet damper in the preceding embodiment and comprises side walls and a top shell wall. The damper element 30 is arranged at the outside of a wall 31 of the outlet 13. The wall 31 is provided with a slot 32 connecting the inside of the outlet 31 to a cavity 33 formed inside the acoustic damper element 30. Accordingly, a Helmholtz type resonator is established which is based on a mass-spring system represented by the volume of the cavity 33 as a mass and the volume of the slot 33 as a spring. Also according to this embodiment, the acoustic damper element 30 is integrally formed with the outlet 13 of the compressor housing 3 by a die casting process.

As already explained for the first embodiment, the acoustic damper element 30 is tuned to be effective to a certain frequency range of a source of noise (Pulsation) inside the outlet 13 by giving the cavity 33 a certain volume and the slot 32 a certain opening area and thickness (radial length). Known frequencies of acoustic waves occurring at the compressor outlet range between 1000 Hz and the frequency at the maximum speed of the compressor wheel.

Figure 5:
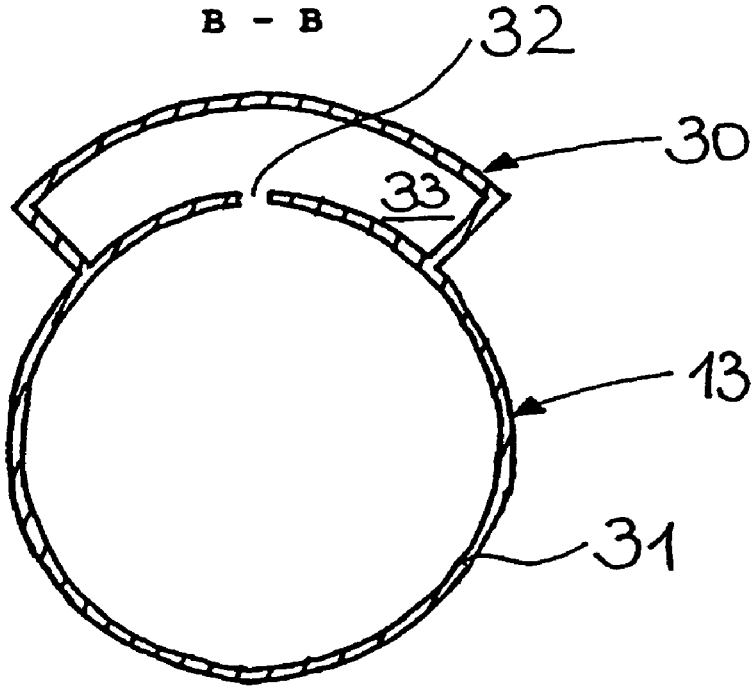
FIG. 5 is a sectional view along line B-B of FIG. 4 schematically showing the outlet provided with one damper element.
Figure 6:
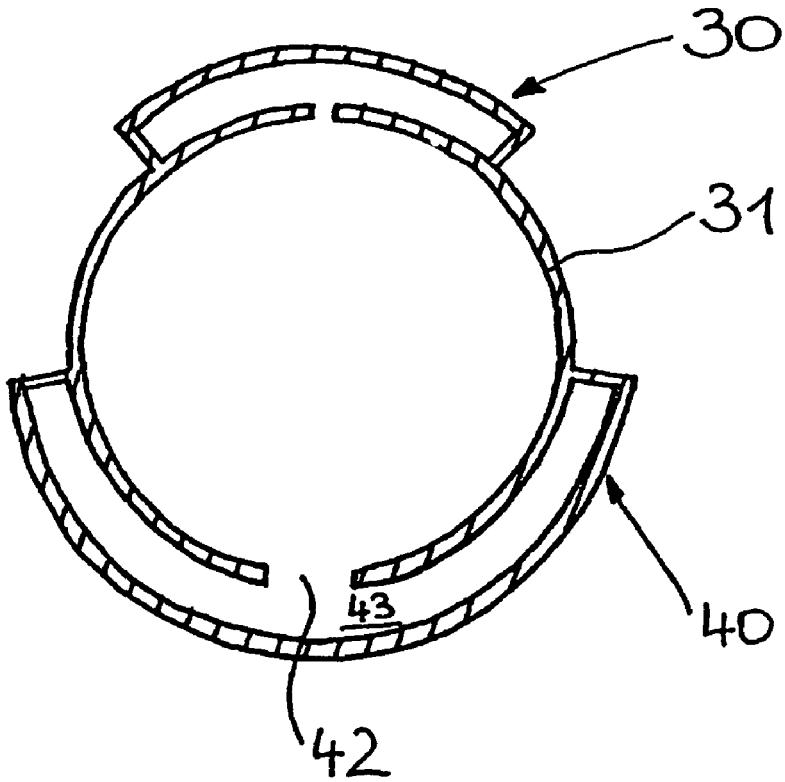
FIG. 6 is a sectional view along line B'-B' of FIG. 4 showing a modification of the embodiment of FIG. 5, wherein the outlet is provided with two damper elements.

Furthermore, FIG. 6 shows a modification of the exemplary embodiment of FIG. 5. Herein, apart from the provision of the acoustic damper element 30, a second acoustic damper element 40 is provided at a position at the outside of the outlet 13 and radially opposite to the position of the acoustic damper element 30. The second acoustic damper element 40 is structured similar to the acoustic damper element 30 and comprises side walls and a top shell wall. A second slot 42 in the wall 31 of the outlet 13 connects the inside of the outlet 13 to a cavity 43 formed in the acoustic damper element 40. The second acoustic damper element 40 differs from the acoustic damper element 30 in that the cavity 43 and the slot 42 have different dimensions as compared to the cavity 33 and the slot 32, respectively. As a result, the frequency range at which the second acoustic damper element 40 is effective is different from that at which the acoustic damper element 30 is effective. Therefore, pulsation noises of different frequency ranges can appropriately be damped at the outlet 13 of the compressor housing 3.

The invention is not restricted to the above described embodiments and can be changed in various modifications without departing from the scope of the invention.

Accordingly, the compressor housing can be equipped with an acoustic damper element only at the inlet or only at the outlet. As a matter of course, the compressor housing can be equipped with at least one acoustic damper element at each of these parts, i.e. at the inlet and at the outlet.

Furthermore, the acoustic damper element may be provided with a plurality of cavities or hollow spaces separated from each other by separating walls. Each cavity can be in communication with the inside of the respective part, i.e. the inlet or the outlet, by a respective slot and each cavity/slot pair may be tuned to a certain frequency range.

Additionally, each cavity of the damper may be connected to the inside of the respective part (inlet or outlet) by a plurality of slots.

According to the above embodiments, the acoustic damper element is integrally formed with the compressor housing by a die casting process. In this case, the material used for the acoustic damper element may be any material used for the compressor housing, such as aluminum. However, the acoustic damper element may also be prepared as a separate member and may be fixed to the compressor housing by welding, brazing or bonding. In this case, the material used for the acoustic damper element may be metal or resin.

According to another modification, the acoustic damper element may also partly be cast by forming the walls around the cavity together with the compressor housing, then machining the slot into the wall of the compressor housing and finally mounting the top wall to the side walls by welding, brazing or bonding.

The invention claimed is:

1. A compressor housing (3) for accommodating a compressor wheel (9), the compressor housing (3) having an inlet (2) and an outlet (13), each being defined by at least in part by a respective wall (14; 31) provided integrally with said compressor housing (3), the inlet (2) further comprising a ported shroud arrangement (15, 16, 17) that comprises a wall portion (15) spaced interiorly to the wall (14) of the inlet (2), wherein at least one acoustic damper element (1) is disposed on the outside of the wall (14) of the inlet (2), characterized in that the at least one acoustic damper element (1) disposed on the outside wall (14) of the inlet (2) is a pulsation type damper element, and wherein the at least one acoustic damper element (1) disposed on the outside of the wall (14) of the inlet (2) is at an axial position corresponding to the ported shroud arrangement (15, 16, 17).

2. The compressor housing (3) according to claim 1, wherein the at least one acoustic damper element (1) is disposed lengthwise along at least a portion of said wall (14).

3. The compressor housing (3) according to any of claims 1 to 2, wherein the at least one acoustic damper element (1) is in contact with said wall (14) of the compressor housing (3).

4. The compressor housing (3) according to claim 1, wherein the at least one acoustic damper element (1) is provided integrally with said wall (14) of the compressor housing (1).

5. The compressor housing (3) according to claim 1, wherein the at least one acoustic damper (1) disposed on the outside wall (14) of the inlet (2) is formed by integrally casting with the compressor housing (3).

6. The compressor housing (3) according to claim 1, wherein the at least one acoustic damper element (1) disposed on the outside wall (14) of the inlet (2) is welded or brazed to the compressor housing (3).

7. The compressor housing (3) according to claim 1, wherein the at least one acoustic damper element (1) disposed on the outside wall (14) of the inlet (2) defines at least one hollow space (22) inside thereof.

8. The compressor housing (3) according to claim 7, wherein the hollow space (22) of the at least one acoustic damper (1) disposed on the outside wall (14) of the inlet (2) is divided by at least one wall to provide divided hollow spaces.

9. The compressor housing (3) according to claim 8, wherein the divided hollow spaces communicate with the inner side of the wall (14) through separate corresponding openings in the wall (14).

10. The compressor housing (3) according to claim 1, wherein the hollow space (22) of the at least one acoustic damper element (1) communicates with the inner side of said wall (14) through at least one opening (23) penetrating said wall (14).

11. The compressor housing (3) according to claim 10, wherein said opening (23) is a slot extending in a direction perpendicular to an axis of the inlet.

12. The compressor housing (3) according to claim 10, wherein a plurality of openings (23) are arranged on a line extending in a direction perpendicular to an axis of the inlet (2).

13. The compressor housing (3) according to claim 1, wherein the at least one acoustic damper element (1) at least partly surrounds said wall (14).

14. A compressor having a compressor housing (3) according to claim 1.

15. A Turbocharger having a turbine for driving a compressor wheel (9) accommodated in a compressor housing (3) according to claim 1.

16. Turbocharger according to claim 15, further comprising an electric motor (8) for electrically assisting the driving of the compressor wheel (9).

* * * * *